United States Patent [19]

Hurwood

[11] 4,332,319

[45] Jun. 1, 1982

[54] HYGIENIC COMFORT PRODUCT

[76] Inventor: David L. Hurwood, 26 E. 93rd St., New York, N.Y. 10028

[21] Appl. No.: 162,853

[22] Filed: Jun. 25, 1980

[51] Int. Cl.[3] ..... B65D 81/22; B65D 81/32; A45D 40/00

[52] U.S. Cl. ..... 206/210; 206/216; 206/362; 206/812; 132/79 R

[58] Field of Search ..... 206/210, 362, 568, 812, 206/823, 216; 132/79

[56] References Cited

U.S. PATENT DOCUMENTS

| | | | |
|---|---|---|---|
| 2,175,133 | 10/1939 | Singleton | 206/823 |
| 2,779,465 | 1/1957 | Anderson | 206/362 |
| 3,150,049 | 9/1964 | Emory | 206/823 |
| 3,534,887 | 10/1970 | Ginsberg | 206/812 |
| 3,889,804 | 6/1975 | Ravich | 206/568 |
| 4,220,244 | 9/1980 | Elmore | 206/210 |

FOREIGN PATENT DOCUMENTS

| | | | |
|---|---|---|---|
| 2717128 | 2/1978 | Fed. Rep. of Germany | 206/210 |

*Primary Examiner*—William T. Dixson, Jr.
*Attorney, Agent, or Firm*—Alan H. Levine

[57] ABSTRACT

A hygienic product for cleaning parts of the body comprising a moistened napkin and a quantity of powder capable of absorbing moisture. The napkin is contained in a first air-tight envelope-like compartment of a packet, and the powder is contained in a second air-tight compartment of the packet. The two compartments may have a common wall between them, in which case each compartment has an outer wall opposite the common wall, whereby all three walls are tearable along a "tear-open" line simultaneously to open both compartments at the same time. The powder may be loose or, alternatively, may be carried by a soft pad or applicator contained within the second compartment.

4 Claims, 3 Drawing Figures

HYGIENIC COMFORT PRODUCT

This invention relates to personal cleanliness and comfort, and more particularly to a product for cleaning, soothing and drying any desired part of the human body.

The invention is particularly useful for cleaning the rectal area after a bowel movement, or at any other time this region needs cleaning and/or drying, such as due to perspiration. It is common experience that after some movements this region can soon feel uncomfortable, itchy, and not completely "clean", even after toilet paper has been used carefully. The present invention corrects this widely experienced problem and meets the need. In this sense, the invention may be thought of as a "portable bidet", with the advantage of incorporating a drying component as an integral part of a two-component product.

The invention is useful for cleaning and drying any part of one's own body, or a child's body needing such care, as for example the genitals, feet and underarms. While the invention can certainly be employed at home, it is believed that its greatest utility is found when one is away from home, such as at work, at public places, camping out, traveling or after participating in an athletic or other strenuous activity.

It is a general object of the invention to provide, in a relatively small package, a product for cleaning and drying parts of the body, which can readily be carried in a pocket or pocketbook.

It is another object of the invention to provide a two-component product, one component being moist for cleaning purposes, and the other component being capable of absorbing moisture for drying purposes. This second component provides positive and veritably complete drying of the rinsed area; thus the drying action is not simply left to evaporation of the moisture supplied by the first component (or to a combination of evaporation plus application of fresh toilet paper, which would still fail to provide complete drying, soothing and comfort).

It is an additional object of the invention to provide such a product wherein each component is packed in an air-tight compartment so as to keep the moist component moist and the moisture-absorbing component dry until use of the product is desired.

It is a further object of the invention, in a preferred configuration, to provide such a product wherein the two compartments have a common wall and can be torn open simultaneously to provide immediate access to the components.

Additional features and advantages of the invention will be apparent from the following description in which reference is made to the accompanying drawings.

Figure 1:
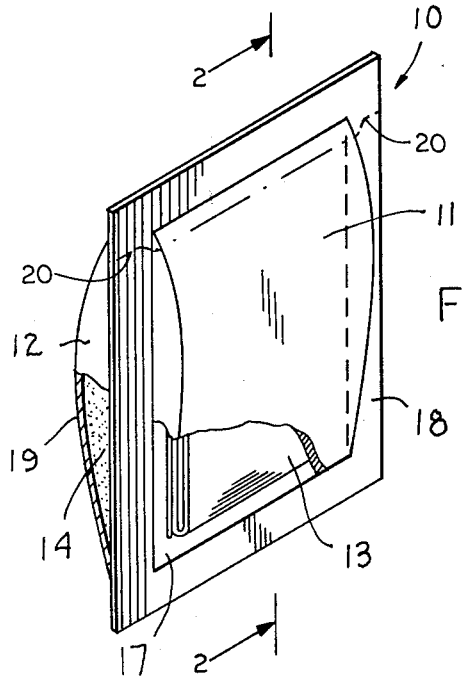
FIG. 1 is a perspective view, partially broken away, of one embodiment of a hygienic product according to this invention.
Figure 2:
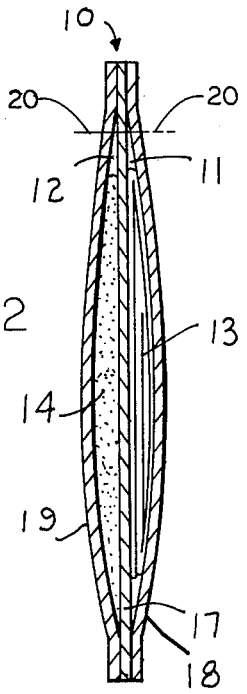
FIG. 2 is a cross-sectional view taken along line 2—2 of FIG. 1.

The hygienic product chosen to illustrate the present invention, and shown in FIGS. 1 and 2, comprises a package or packet 10 including two compartments 11 and 12. Compartment 11 contains a moistened napkin 13 and compartment 12 contains a quantity of loose powder 14.

Napkin 13 is formed of a suitable fibrous material, such as paper or a textile fabric. The material should be one having the ability to retain moisture and which does not irritate the skin, especially sensitive areas of it. Furthermore, the napkin material is preferably flushable in the toilet, a feature important when the napkin is used to clean the rectal area after a movement. Napkin 13 is saturated with a suitable liquid such as water with alcohol, and/or propylene glycol, resorcin, one or more appropriate germicidal agents, etc., i.e., a liquid or combination of liquids suitable for cleaning sensitive (as well as less sensitive) areas of the skin. A mild hygienic scent may included in the liquid. The liquid must, of course, be one which is not harmful when applied to normal skin. For compactness, napkin 13 is preferably folded before being enclosed within envelope 11.

Powder 14 may be zinc oxide or any other suitable powdered material, or combination of materials, capable of absorbing moisture and non-irritating to the skin and not harmful in any way. If desired, the powder may include a cooling ingredient such as menthol and/or a mild pleasantly-hygienic scent.

Compartments 11 and 12 are made of a moisture-impregnable sheet material, tearable along a scored or creased "tear-open" line, such as metal foil or treated paper. Preferably, the compartments are formed with a common wall 17 between them, compartment 11 comprising an outer wall 18 and wall 17, and compartment 12 comprising an outer wall 19 and wall 17. The peripheral edges of all three walls 17–19 are sealed together in an air-tight manner, such as by heat sealing or by using a suitable adhesive or crimp. One construction variant is that the outer walls may be manufactured of one strip of material folded at one end, thus requiring sealing or other joining of only the remaining three edges. Thus both compartments are air-tight, so that the moisture carried by napkin 13 cannot evaporate or leak and the powder 14 cannot absorb moisture either from napkin 13 or from the atmosphere.

In use, it is suggested that the rectal area first be cleaned in the normal way with toilet paper. Then, one end of packet 10 is torn, such as along line 20 (FIGS. 1 and 2), simultaneously opening both compartments 11 and 12. To facilitate opening, the "tear line" may be scored or creased in such a manner as not to compromise the air-tight property previously mentioned. Moist napkin 13 is withdrawn from compartment 11, unfolded, and used to clean the area thoroughly, after which it is simply dropped into the toilet. The area may then be partially dried using fresh toilet paper. Finally, powder 14 is poured out of its compartment on to clean toilet paper and used to dry the area completely and comfortably.

Figure 3:
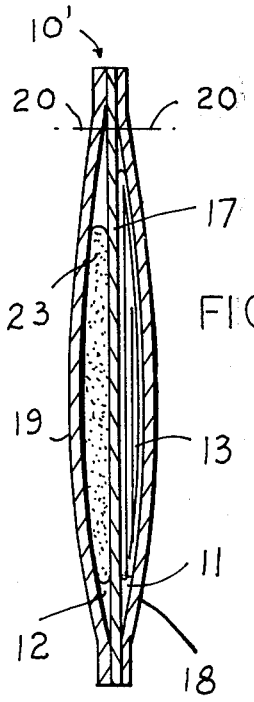
FIG. 3 is a view similar to FIG. 2 of an alternative embodiment of the invention.

Package 10' of FIG. 3 is identical to package 10 of FIGS. 1 and 2, except that instead of powder 14 being loose in compartment 12, a soft pad, webbing or gauze, or a wad of cotton 23, impregnated with the powder, is contained in envelope 12. Thus, in this embodiment, the powder comes with its own applicator for gently patting onto, or dusting, the area of body to be dried. The used applicator, like the used napkin, is dropped ino the toilet bowl.

While a three-wall compartment structure, as shown in the drawings, is preferred, two separate compartments or envelopes containing the moist napkin and the powder, respectively, could be employed, the envelopes possibly being joined together along one edge by a line of perforations, scoring or creasing; other constructions of this invention are feasible and comprehended within this application. Furthermore, if the compartments 11 and 12 are made of a toilet-flushable material, the entire empty package 10 can be disposed of down the toilet. Otherwise it is simply disposed of in a receptacle such as a waste basket for paper towels.

The invention has been shown and described in preferred form only, and by way of example, and many variations may be made in the invention which will still be comprised within its spirit. The present invention includes and encompasses not only various means of joining or associating the two integral components, but also:

(a) Various packaging methods: For example, one unit (including both components) may be packaged alone, for distributing or selling by hand (e.g., on planes, at restaurants, in hospitals) or dispensing in a vending machine (e.g., in public lavoratories). For normal sale in retail outlets, several units would be packaged together, in boxes or other containers of various sizes appropriate to various customer categories (market segments) to which the product may be marketed or distributed in the United States and other countries.

(b) Dimensions: In different models of the product, the unfolded napkin may be of various sizes, with the amount of powder (or size of powder-saturated pad or wad) varying in proportion to it. No specific dimensions need be indicated in this application, other than the general note that this is a convenience product, single or several units of which are capable of being carried in pocket or purse without causing inconvenient bulk. In its cross-section dimension the two-compartment (or two-envelope) packet is thin and flat; the other two dimensions perhaps lie somewhere between one and three (or more) inches. The latter two dimensions may form a rectangle, a square, or other shape (for example, oval at one or both ends). Dimensions may vary depending on market segment for which a particular model is intended.

(c) Chemical ingredients for moist napkin and for powder: These may vary, again in accordance with nature of intended user, although they shall, in most formulations, be bland, gentle and soothing, since the invention is intended primarily, though not exclusively, for sensitive and at times tender, parts of the body: the anal and rectal area, as well as pubic, genital and perineal areas. One formulation may be standard, for all-purpose use and "normal" skin. Another may be even more cooling, soothing and comforting, containing, for example, menthol and/or other cooling agent in addition to, or in place of, other ingredients such as have previously been mentioned, for instances where hemorrhoids or other irritating conditions are present (although the product is not a medicinal one, as will be indicated in labeling and directions). Still another formulation may be exceptionally bland for use by parents or other adults on infants or small children.

(d) Composition of material enclosing the two components: The standard composition of the packet material may be light, durable enough to protect the two components until use as heretofore described, and pliable or flexible enough for easy disposal when emptied (for example, by flushing, or by temporarily putting in pocket or purse for disposal in waste receptacle). A more rugged material may be used in the variant of product meant for outdoor sports participants (including, for example, mariners, bicyclists, campers) to carry (perhaps singly) in pockets, knapsacks or other holders in which the product must stand up to somewhat rough or rugged handling or climatic conditions before being opened and used. (Other examples of potential users for whom this more rugged construction would be suitable are outdoor workers, military personnel, and adolescents.)

(e) Construction: Consonant with the essential "two-component" aspect of this invention (moisturized cleaning plus drying element), various construction alternatives are possible and embraced by this application. One variant (two joined envelopes) has been mentioned. Another variant, for example, might provide "double protection" for one or both of the two elements, by enclosing element within a little envelope (for instance, of treated paper or thin and tearable, although nonporous, fabric) which is removable intact (unopened) from its compartment; this "inner envelope" may then be opened and its contents (moisture or drying component) applied, without impairing the air-tight integrity and freshness of the other component, which may be saved for subsequent use.

It is understood, therefore, that the invention is not limited to any specific form or embodiment except insofar as such limitations are included in the appended claims.

I claim:

1. A hygienic product for cleaning, soothing and comforting the rectal area of the human body, comprising (a) a napkin moistened with a liquid capable of cleaning the rectal area of the body without irritating the skin of that area, said liquid containing a germicidal agent not harmful to said skin, (b) a first air-tight compartment containing the napkin, (c) a quantity of powder capable of absorbing moisture and non-irritating to the skin of the rectal area, and (d) a second air-tight compartment containing the powder.

2. A hygienic product as defined in claim 1 including means joining the two compartments to keep them together at least until the time their contents are used.

3. A hygienic product as defined in claim 2 wherein one wall of each compartment is a wall common to both compartments, each compartment also having an outer wall opposite the common wall, and all three walls being tearable simultaneously to open both compartments at the same time.

4. A hygienic product as defined in claim 1 including a soft pad impregnated with the quantity of powder, the pad being contained within the second compartment.

* * * * *